US011260664B2

(12) United States Patent
Nakamura et al.

(10) Patent No.: US 11,260,664 B2
(45) Date of Patent: Mar. 1, 2022

(54) LIQUID EJECTING APPARATUS AND RECORDING SYSTEM

(71) Applicant: SEIKO EPSON CORPORATION, Tokyo (JP)

(72) Inventors: Hiroyuki Nakamura, Shiojiri (JP); Izumi Nozawa, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/887,789

(22) Filed: May 29, 2020

(65) Prior Publication Data

US 2020/0376857 A1 Dec. 3, 2020

(30) Foreign Application Priority Data

May 30, 2019 (JP) ..... JP2019-101041

(51) Int. Cl.
*B41J 2/165* (2006.01)
*B41J 11/00* (2006.01)

(52) U.S. Cl.
CPC ..... *B41J 2/16508* (2013.01); *B41J 11/0024* (2021.01)

(58) Field of Classification Search
CPC ..... B41J 11/002
See application file for complete search history.

(56) References Cited

U.S. PATENT DOCUMENTS

2012/0249704 A1 10/2012 Kato
2016/0034800 A1* 2/2016 Unno ..... G06K 15/403 358/1.12
2016/0375702 A1 12/2016 Kobashi et al.
2017/0050448 A1* 2/2017 Jang ..... B41J 11/0005
2018/0147863 A1* 5/2018 Wierda ..... B41J 29/54
2019/0193426 A1* 6/2019 Mizushima ..... B41J 13/02

FOREIGN PATENT DOCUMENTS

JP 2012-206304 10/2012
JP 2012-210758 11/2012
JP 2013-039759 2/2013
JP 2017-013240 1/2017

* cited by examiner

*Primary Examiner* — Justin Seo
(74) *Attorney, Agent, or Firm* — Workman Nydegger

(57) ABSTRACT

A liquid ejecting apparatus including a transporting portion that transports a medium along a transport path, a liquid ejecting head that performs recording by ejecting, through a nozzle, a liquid onto the medium that is being transported, a mounting portion in which a liquid storage portion that stores the liquid supplied to the liquid ejecting head is mounted, and a heating portion that heats the medium on which the recording has been performed. The transport path includes an upper path positioned above the mounting portion in a vertical direction. After transporting and passing the medium, on which the recording has been performed, through the upper path, the transporting portion discharges the medium through a discharge port. The heating portion is provided above the mounting portion in the vertical direction and heats the medium transported through the upper path.

16 Claims, 8 Drawing Sheets

LIQUID EJECTING APPARATUS AND RECORDING SYSTEM

The present application is based on, and claims priority from JP Application Serial Number 2019-101041, filed May 30, 2019, the disclosure of which is hereby incorporated by reference herein in its entirety.

BACKGROUND

1. Technical Field

The present disclosure relates to a liquid ejecting apparatus such as a printer, and to a recording system including the liquid ejecting apparatus.

2. Related Art

For example, as in JP-A-2017-13240, there is a printer, which is an example of a liquid ejecting apparatus, that performs printing by ejecting ink, which is an example of a liquid, supplied from a liquid storage member, which is an example of a liquid storage portion, from a print head, which is an example of a liquid ejecting head. The printer includes a drying portion, which is an example of a heating portion, that dries a paper sheet, which is an example of a medium, on which ink has adhered.

The liquid storage member is provided above the drying portion. Accordingly, the liquid storage member is heated by ascending air heated by the drying portion.

When the liquid storage portion is moderately heated, the viscosity of the stored liquid is lowered and it will be easier to supply the liquid. However, when the liquid storage portion is excessively heated, the evaporated amount of the stored liquid becomes large.

SUMMARY

A liquid ejecting apparatus overcoming the above issue includes a transporting portion that transports a medium along a transport path, a liquid ejecting head that performs recording by ejecting, through a nozzle, a liquid onto the medium that is being transported, a mounting portion in which a liquid storage portion that stores the liquid supplied to the liquid ejecting head is mounted, and a heating portion that heats the medium on which the recording has been performed. The transport path includes an upper path positioned above the mounting portion in a vertical direction. After transporting and passing the medium, on which the recording has been performed, through the upper path, the transporting portion discharges the medium through a discharge port. The heating portion is provided above the mounting portion in the vertical direction and heats the medium transported through the upper path.

A recording system overcoming the above issue includes a liquid ejecting apparatus that performs recording on a medium, a medium processing apparatus that includes a processing portion that performs a process on the medium on which recording has been performed with the liquid ejecting apparatus. The liquid ejecting apparatus includes a transporting portion that transports the medium along a transport path, a liquid ejecting head that performs the recording by ejecting, through a nozzle, a liquid onto the medium that is being transported, a mounting portion in which a liquid storage portion that stores the liquid supplied to the liquid ejecting head is mounted, and a heating portion that heats the medium on which the recording has been performed. The transport path includes an upper path positioned above the mounting portion in a vertical direction, the transporting portion transports and passes the medium, on which the recording has been performed, through the upper path and discharges the medium through a discharge port and towards the medium processing apparatus, and the heating portion is provided above the mounting portion in the vertical direction and heats the medium transported through the upper path.

DESCRIPTION OF EXEMPLARY EMBODIMENTS

Figure 1:
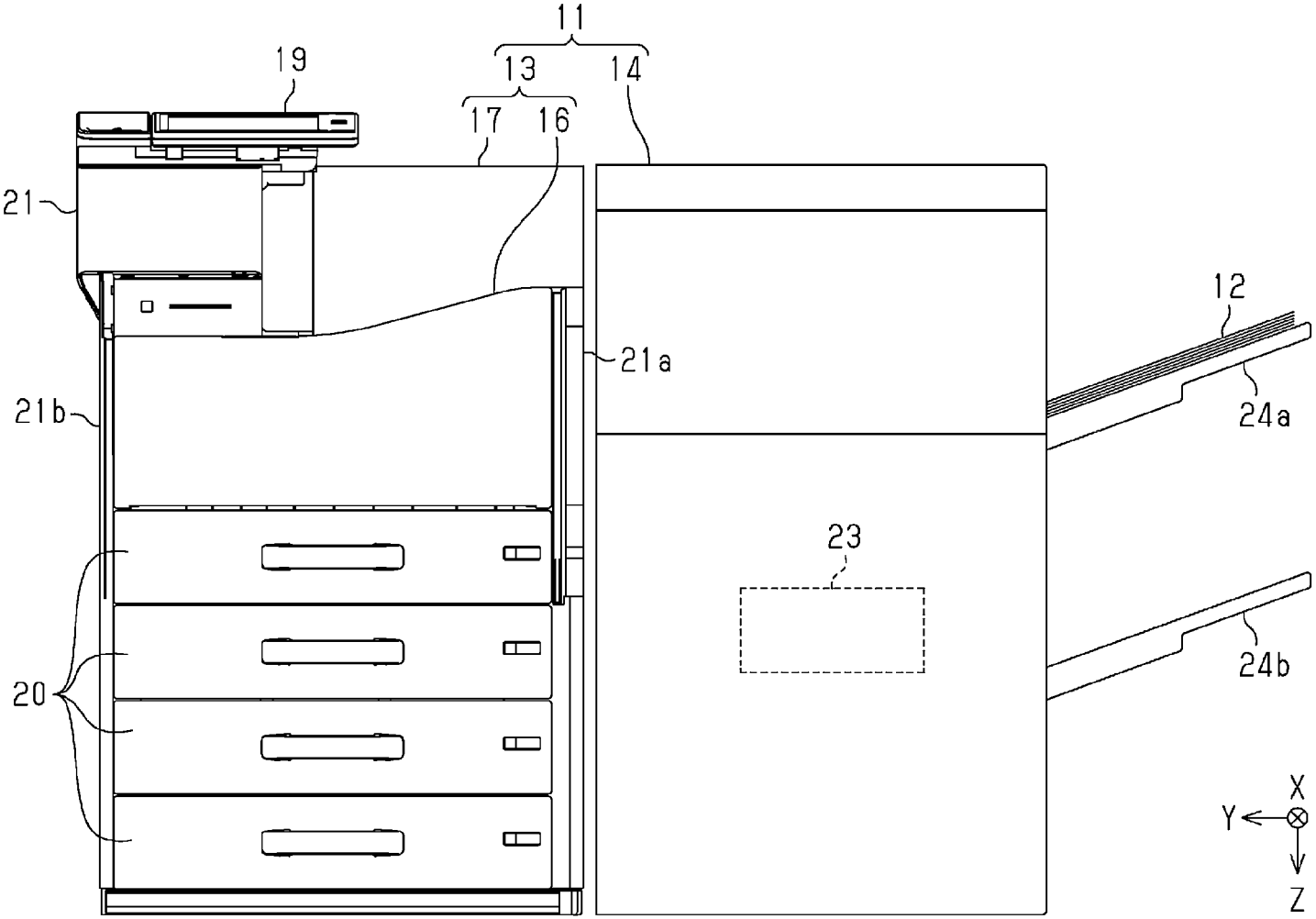
FIG. 1 is a schematic perspective view of an exemplary embodiment of a recording system.

An exemplary embodiment of a recording system including a liquid ejecting apparatus will be described hereinafter with reference to the drawings. The liquid ejecting apparatus is an ink jet printer that prints characters and images on a medium such as a sheet of paper by ejecting ink, which is an example of a liquid, onto a medium, for example.

In the drawing, a recording system 11 is depicted as being placed on a horizontal surface. The gravitational direction is indicated by the Z-axis, and the directions extending along the horizontal surface are indicated by the X-axis and the Y-axis. The X-axis, the Y-axis, and the Z-axis are orthogonal to each other. In the following description, a direction parallel to the X-axis is also referred to as a depth direction X, a direction parallel to the Y-axis is also referred to as a width direction Y, and a direction parallel to the Z-axis is also referred to as a vertical direction Z.

As illustrated in FIG. 1, the recording system 11 includes a liquid ejecting apparatus 13 that performs recording on a medium 12, and a medium processing apparatus 14 that performs a process on the medium 12 on which recording has been performed with the liquid ejecting apparatus 13. The liquid ejecting apparatus 13 and the medium processing apparatus 14 are provided side by side in the width direction Y.

The liquid ejecting apparatus 13 may include a recording unit 16 that performs recording on the medium 12, and a heating unit 17 that heats the medium 12 on which recording has been performed. The heating unit 17 may be provided so as to be detachable from the recording unit 16.

The recording unit 16 may include an operation unit 19 operated by the user, and a cassette 20 that can be accommodated with the mediums 12 stacked therein. The recording unit 16 may include a plurality of cassettes 20 arranged in the vertical direction Z. The cassette 20 may be provided so as to be drawable from the housing 21. The housing 21 includes a first side 21*a* and a second side 21*b* opposite the first side 21*a* in the width direction Y. The first side 21*a* is a surface adjacent to the medium processing apparatus 14.

The medium processing apparatus 14 includes a processing portion 23 that performs a process on the medium 12. The medium processing apparatus 14 may include a first mounting portion 24*a* that, among the mediums 12 sent from the liquid ejecting apparatus 13, mounts thereon the mediums 12 on which no process has been performed with the processing portion 23, and a second mounting portion 24*b* that mounts thereon the mediums 12 on which a process has been performed with the processing portion 23. The processing portion 23 of the present exemplary embodiment performs stapling on a plurality of mediums 12 with a stapler.

Figure 2:
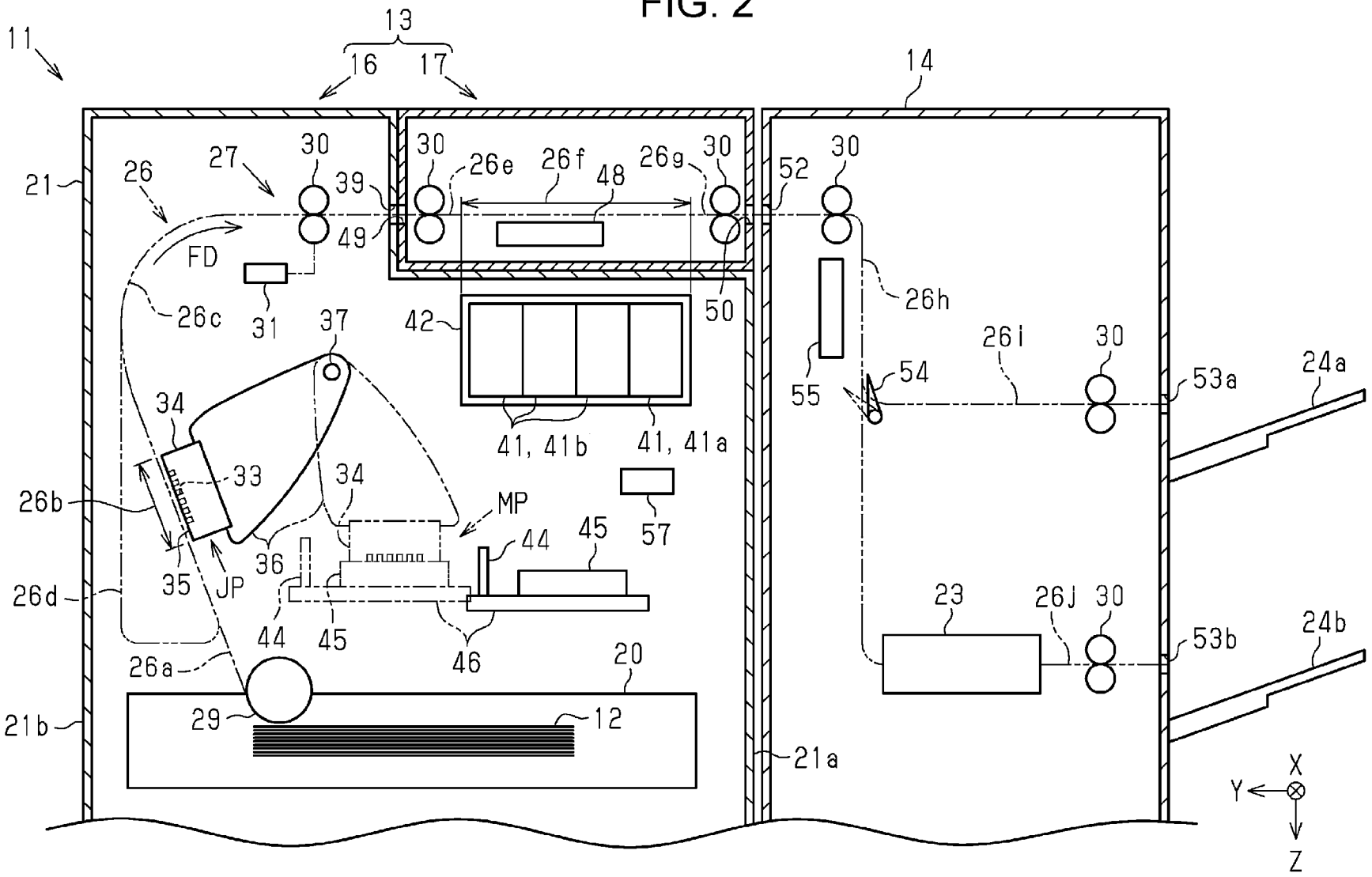
FIG. 2 is a schematic cross-sectional view of an exemplary embodiment of the recording system.

As illustrated in FIG. 2, a transport path 26 depicted by a two-dot chain line is provided in the recording system 11 from a cassette 20 included in the liquid ejecting apparatus 13 to the first mounting portion 24*a* or the second mounting portion 24*b* included in the medium processing apparatus 14. The recording system 11 includes a transporting portion 27 that transports the medium 12 along the transport path 26.

The transporting portion 27 may include a pickup roller 29 that, among the mediums 12 stored in the cassette 20, sends out the uppermost medium 12, and a plurality of pairs of transport rollers 30 that transport the medium 12, which has been sent from the pickup roller 29, in a transport direction FD. The plurality of pairs of transport rollers 30 are disposed along the transport path 26.

In the transporting portion 27, transport motors 31 that drive the pairs of transport rollers 30 may each be provided in the liquid ejecting apparatus 13 and the medium processing apparatus 14, or the pairs of transport rollers 30 provided in the medium processing apparatus 14 may be driven by the transport motor 31 provided in the liquid ejecting apparatus 13. The transporting portion 27 may rotate the plurality of pairs of transport rollers 30 with a single transport motor 31, or a plurality of transport motors 31 may be provided. The transporting portion 27 transports the medium 12 from the cassette 20 positioned upstream in the transport direction FD towards the first mounting portion 24*a* or the second mounting portion 24*b* positioned downstream in the transport direction FD.

The transport path 26 includes an upstream path 26*a*, a recording path 26*b*, a downstream path 26*c*, an inversion path 26*d*, a connection path 26*e*, an upper path 26*f*, a discharge path 26*g*, an introduction path 26*h*, a first delivery path 26*i*, and a second delivery path 26*j*. The recording unit 16 includes the upstream path 26*a*, the recording path 26*b*, the downstream path 26*c*, and the inversion path 26*d*. The heating unit 17 includes the connection path 26*e*, the upper path 26*f*, and the discharge path 26*g*. The medium processing apparatus 14 includes the introduction path 26*h*, the first delivery path 26*i*, and the second delivery path 26*j*.

The recording unit 16 includes a liquid ejecting head 34 that performs recording by ejecting a liquid on the transported medium 12 through nozzles 33. In other words, the recording unit 16 is configured to include the liquid ejecting head 34, and the housing 21 included in the recording unit 16 houses the liquid ejecting head 34. The liquid ejecting head 34 of the present exemplary embodiment is a so-called line head capable of simultaneously ejecting a liquid across the depth direction X. The liquid ejecting head 34 includes a nozzle formation surface 35 in which the nozzles 33 are formed. The recording unit 16 may include a holding portion 36 that holds the liquid ejecting head 34, and a rotation shaft 37 that rotatably supports the holding portion 36.

The liquid ejecting head 34 moves about the rotation shaft 37 by having the holding portion 36 rotate about the rotation shaft 37. The liquid ejecting head 34 positioned at a maintenance position MP depicted by the two-dot chain line in FIG. 2 moves in a clockwise direction in FIG. 2 to an ejection position JP depicted by a solid line in FIG. 2. The liquid ejecting head 34 positioned at the ejection position JP moves in a counterclockwise direction in FIG. 2 and returns to the maintenance position MP.

In the transport path 26, the portion opposing the liquid ejecting head 34 positioned at the ejection position JP is the recording path 26*b*. In other words, the recording path 26*b* is a path in which the liquid ejecting head 34 performs recording. The upstream path 26*a* is positioned upstream of the recording path 26*b* in the transport direction FD and couples the cassette 20 and the recording path 26*b* to each other. The downstream path 26*c* is positioned downstream of the recording path 26*b* in the transport direction FD and couples the recording path 26*b* and a send-out port 39 to each other.

The inversion path 26*d* is a path that couples the downstream path 26*c* and the upstream path 26*a* to each other. When a so-called double-side printing in which an image is recorded on both surfaces of the medium 12 is performed, the liquid ejecting head 34 first performs recording on a front surface of the medium 12 sent from the cassette 20. The medium 12 that has passed through the recording path 26*b* passes through the inversion path 26*d* and is returned to the upstream path 26*a*. The liquid ejecting head 34 ejects a liquid on a back surface of the medium 12 that has been transported to the recording path 26*b* once more and performs recording.

A switch back path that extends parallel to the downstream path 26*c* may be provided downstream of the recording path 26*b*, and a path that couples the switch back path and the upstream path 26*a* may be the inversion path 26*d*. By providing the switch back path separate from the downstream path 26*c*, even when a medium 12, on which an image has been recorded on one side in the recording path 26*b* during double-side printing, is transported to the inversion path 26*d* through the switch back path, the next medium 12 can be transported to the downstream path 26*c* side. With the above, a decrease in throughput of double-side printing can be suppressed.

The liquid ejecting head 34 positioned at the ejection position JP is in a first position in which the nozzle formation surface 35 is inclined against the horizontal surface. The liquid ejecting head 34 positioned at the maintenance position MP is in a second position in which the inclination of the nozzle formation surface 35 against the horizontal surface is smaller than that of the first position. In the second position, the nozzle formation surface 35 may coincide with the horizontal surface.

The liquid ejecting head 34 positioned at the ejection position JP performs recording on the medium 12 by ejecting a liquid through the nozzles 33 while being in the first position. The liquid ejecting head 34 positioned at the ejection position JP may perform recording on the medium 12 at a position that is closer to the second side 21*b* than to the first side 21*a* in the width direction Y. The liquid ejecting apparatus 13 ejects the liquid in a direction perpendicular to the nozzle formation surface 35. Accordingly, the direction in which the liquid ejecting head 34 ejects the liquid to perform recording is different from the vertical direction Z.

The recording unit 16 includes a mounting portion 42 in which a liquid storage portion 41 that stores the liquid supplied to the liquid ejecting head 34 is mounted. The liquid storage portion 41 may be a replaceable cartridge or a tank to which the liquid can be supplied.

A plurality of liquid storage portions 41 that each store a different type of liquid may be mounted in the mounting portion 42. The different types of liquid may be ink of different colors. A first liquid storage portion 41*a* for black ink and second liquid storage portions 41*b* for colored ink can be mounted in the mounting portion 42 of the present exemplary embodiment. The amount of liquid that can be stored in the first liquid storage portion 41*a* and that in each of the second liquid storage portions 41*b* may be different.

The recording unit 16 may include a wiping portion 44 configured to wipe the liquid ejecting head 34, a cap 45 that is configured to form a closed space between the liquid ejecting head 34 in which the nozzles 33 are open, and a support portion 46 that moveably supports the wiping portion 44 and the cap 45. The support portion 46 may be provided for each of the wiping portion 44 and the cap 45.

The wiping portion 44 moves relative to the liquid ejecting head 34 and wipes the liquid ejecting head 34. Specifically, the wiping portion 44 moves in the width direction Y from a standby position depicted by a solid line in FIG. 2, which is where the wiping portion 44 away from the liquid ejecting head 34 stands by, to wipe the nozzle formation surface 35. The standby position may be positioned below the mounting portion 42 in the vertical direction Z. Note that the wiping portion 44 may be configured to wipe the nozzle formation surface 35 by moving in the direction extending from the position depicted by the two-dot chain line in FIG. 2 towards the position depicted by a solid line in FIG. 2, in other words, in the −Y direction.

The cap 45 may be provided so as to be moveable between a closed space forming position depicted by a two-dot chain line in FIG. 2 and a retracted position depicted by a solid line in FIG. 2. The closed space forming position is a position where the closed space is formed with the liquid ejecting head 34 positioned at the maintenance position MP. The retracted position is a position away from the closed space forming position. The retracted position may be positioned below the mounting portion 42 in the vertical direction Z.

The wiping portion 44 positioned at the standby position and the cap 45 positioned at the retracted position may overlap the mounting portion 42 in the vertical direction Z. In other words, at least portions of the wiping portion 44 and the cap 45 may be positioned at a position that is the same as that of the mounting portion 42 in the depth direction X. At least portions of the wiping portion 44 and the cap 45 may be positioned at a position that is the same as that of the mounting portion 42 in the width direction Y.

The heating unit 17 includes a first heating portion 48 that heats the medium 12 on which recording has been performed. In other words, the heating unit 17 is configured to include the first heating portion 48. The first heating portion 48 may be provided at a position that is closer to the first side 21*a* than to the second side 21*b* in the width direction Y. Desirably, the first heating portion 48 is, with respect to the liquid ejecting head 34 that is positioned at the ejection position JP and that is in the first position, provided at a direction opposite the direction in which the nozzle formation surface 35 faces. Furthermore, in the above, it is more desirable that the first heating portion 48 be provided on an imaginary line orthogonal to the nozzle formation surface 35. When the first heating portion 48 is provided in the above manner, the heat released from the first heating portion 48 does not easily become transmitted to the liquid ejecting head 34, and evaporation of the liquid inside the liquid ejecting head 34 can be suppressed.

The heating unit 17 is provided above the mounting portion 42 in the vertical direction Z. The connection path 26*e* included in the heating unit 17 is coupled to the downstream path 26*c* included in the recording unit 16 in a detachable manner. The connection path 26*e* and the downstream path 26*c* are coupled to each other by providing the heating unit 17 so that the positions of the send-out port 39 and a send-in port 49 match each other. A state in which the downstream path 26*c* and the connection path 26*e* are coupled to each other is a state in which the medium 12 can be transported from the downstream path 26*c* to the connection path 26*e*. The connection path 26*e* is detached from the downstream path 26*c* by removing the heating unit 17 from the recording unit 16.

The heating unit 17 may be configured to include the send-in port 49, the connection path 26*e*, the upper path 26*f*, the discharge path 26*g*, and a discharge port 50. The connection path 26*e* is a path that couples the send-in port 49 and the upper path 26*f* to each other. In other words, in a state in which the heating unit 17 is mounted in the recording unit 16, the connection path 26*e* couples the downstream path 26*c* and the upper path 26*f* to each other. The upper path 26*f* is a portion positioned above the mounting portion 42 in the vertical direction Z. The discharge path 26*g* is a path that couples the upper path 26*f* and the discharge port 50 to each other. The transporting portion 27 transports the medium 12 sent into the heating unit 17 through the send-in port 49 in the order of the connection path 26*e*, the upper path 26*f*, and the discharge path 26*g*. In other words, the transporting portion 27 transports the medium 12 on which recording has been performed through the upper path 26*f* and discharges the medium 12 towards the medium processing apparatus 14 through the discharge port 50.

In a state in which the heating unit 17 is mounted in the recording unit 16, the first heating portion 48 is positioned above the mounting portion 42 in the vertical direction Z. The first heating portion 48 heats the medium 12 transported through the upper path 26*f*. The first heating portion 48 may be provided between the mounting portion 42 and the upper path 26*f* in the vertical direction Z. Desirably, the first heating portion 48 is, in the vertical direction Z, provided at a position that overlaps at least one of the second liquid storage portions 41*b* and at a position that does not overlap the first liquid storage portion 41*a*. However, the first heating portion 48 may be provided at a position that overlaps at least one of the second liquid storage portions 41*b* and the first liquid storage portion 41*a*.

The medium processing apparatus 14 introduces the medium 12 discharged from the liquid ejecting apparatus 13 through an introduction port 52. The introduction path 26*h* is a path between the introduction port 52 and the processing portion 23. The first delivery path 26*i* is a path that branches from the introduction path 26*h* and that couples the introduction path 26*h* and a first delivery port 53*a* to each other. The medium processing apparatus 14 may include a flap 54 that sends the medium 12 from the introduction path 26*h* to the first delivery path 26*i*. The second delivery path 26*j* is a path between the processing portion 23 and a second delivery port 53*b*.

The medium processing apparatus 14 may include a second heating portion 55 that heats the medium 12 sent from the liquid ejecting apparatus 13. The second heating portion 55 heats the medium 12 transported through the introduction path 26*h*. The second heating portion 55 may be provided between the introduction path 26*h* and the liquid ejecting apparatus 13 in the width direction Y, or may be provided between the introduction path 26*h* and the mounting portion 42 in the width direction Y.

The recording system 11 includes a control unit 57 that controls the operation of the recording system 11. The recording system 11 may control both the liquid ejecting apparatus 13 and the medium processing apparatus 14 with a single control unit 57 or a control unit 57 may be provided for each of the apparatuses. The control unit 57 is configured to include a CPU and a memory, for example. The control unit 57 controls the recording system 11 by having the CPU execute a program stored in the memory.

An operation of the present exemplary embodiment will be described.

The liquid ejecting apparatus 13 feeds the medium 12 stored in the cassette 20 by driving the pickup roller 29. The transporting portion 27 transports the medium 12 in the order of the upstream path 26*a*, the recording path 26*b*, and the downstream path 26*c*, and sends the medium 12 to the heating unit 17. The liquid ejecting head 34 performs recording on the medium 12 passing through the recording path 26*b*.

When the processing portion 23 is to perform a process on the medium 12, the first heating portion 48 and the second heating portion 55 may heat the medium 12. In other words, the processing portion 23 may perform a process on the heated medium 12.

Specifically, when the processing portion 23 is to perform a process on the medium 12, the transporting portion 27 transports the medium 12 in the order of the connection path 26*e*, the upper path 26*f*, the discharge path 26*g*, and the introduction path 26*h*. The medium 12 that has been transported to the second delivery path 26*j* through via the processing portion 23 is delivered through the second delivery port 53*b* and is mounted on the second mounting portion 24*b*. In so doing, the first heating portion 48 heats the medium 12 transported through the upper path 26*f*. The second heating portion 55 heats the medium 12 transported through the introduction path 26*h*.

When the processing portion 23 is not to perform a process on the medium 12, the transporting portion 27 transports the medium 12 in the order of the connection path 26*e*, the upper path 26*f*, the discharge path 26*g*, the introduction path 26*h*, and the first delivery path 26*i*. In so doing, the first heating portion 48 and the second heating portion 55 do not have to heat the medium 12. The medium 12 transported through the first delivery path 26*i* and delivered through the first delivery port 53*a* is mounted on the first mounting portion 24*a*.

Effects of the present exemplary embodiment will be described.

(1) When medium 12 transported by the transporting portion 27 is transported through the upper path 26*f* positioned above the mounting portion 42, the medium 12 is heated by the first heating portion 48. Since the first heating portion 48 is provided above the mounting portion 42, the ascending air heated by the first heating portion 48 moves away from the liquid storage portion 41 mounted in the mounting portion 42. Accordingly, while facilitating drying of the medium 12, the liquid storage portion 41 can be suppressed from being excessively heated.

(2) When a liquid in which the viscosity thereof is changed greatly by temperature is used, the viscosity of the liquid increases when the temperature is low. Accordingly, the liquid storage portion 41 may not be able to supply a sufficient amount of liquid to the liquid ejecting head 34. In that respect, the first heating portion 48 is provided between the mounting portion 42 and the upper path 26*f* in the vertical direction Z. In other words, the air heated by the first heating portion 48 escapes upwards while the liquid storage portion 41 is moderately heated by the heat radiated from the first heating portion 48, which can reduce the viscosity of the liquid stored in the liquid storage portion 41.

(3) The heating unit 17 provided with the first heating portion 48 is detachable from the recording unit 16. Accordingly, when the first heating portion 48 is replaced, for example, the first heating portion 48 can be replaced easily by removing the heating unit 17 from the recording unit 16. Furthermore, by removing the heating unit 17 from the recording unit 16 and using the area in which the heating unit 17 is provided as the mounting portion, it will be possible to solely use the recording unit 16.

(4) The liquid ejecting head 34 performs printing on the medium 12 at a position that is closer to the second side 21*b* than to the first side 21*a* in the width direction Y. The first heating portion 48 is provided at a position that is closer to the first side 21*a* than to the second side 21*b*. In other words, since the first heating portion 48 is provided away from the liquid ejecting head 34 in the width direction Y, evaporation of the liquid inside the liquid ejecting head 34 caused by the first heating portion 48 heating the liquid ejecting head 34 can be suppressed.

(5) When the wiping portion 44 is heated, the liquid adhered to the wiping portion 44 may evaporate and the viscosity of the liquid may increase. In that respect, the wiping portion 44 positioned at the standby position is positioned below the mounting portion 42 and overlaps the mounting portion 42 in the vertical direction Z. In other words, when the wiping portion 44 is positioned at the standby position, the mounting portion 42 is positioned between the wiping portion 44 and the first heating portion 48; accordingly, heating of the wiping portion 44 can be prevented with the mounting portion 42.

(6) When the cap 45 is heated, the liquid adhered to the cap 45 may evaporate and the viscosity of the liquid may increase. In that respect, the cap 45 positioned at the retracted position is positioned below the mounting portion 42 and overlaps the mounting portion 42 in the vertical direction Z. In other words, when the cap 45 is positioned at the retracted position, the mounting portion 42 is positioned between the cap 45 and the first heating portion 48; accordingly, heating of the cap 45 can be prevented with the mounting portion 42.

(7) For example, when the mediums 12 are mounted while not being sufficiently dried, the mediums 12 may be displaced with respect to each other and the process may not be performed appropriately. In that respect, the processing portion 23 performs a process on the mediums 12 that have been heated by the first heating portion 48. Accordingly, insufficient drying of the mediums 12 on which the process is performed can be suppressed.

(8) The medium processing apparatus 14 includes the first mounting portion 24*a* on which the medium 12 on which no process is performed by the processing portion 23 is mounted, and the second mounting portion 24*b* on which the medium 12 on which the process is performed by the processing portion 23 is mounted. Accordingly, the medium 12 on which no process has been performed and the medium 12 on which the process has been performed can be sorted easily.

(9) The medium processing apparatus 14 includes the second heating portion 55 that heats the medium 12 transported through the introduction path 26*h*. Accordingly, compared with heating the medium 12 with the first heating portion 48 alone, insufficient drying of the medium 12 on which the process is performed by the processing portion 23 can be suppressed. Furthermore, the second heating portion 55 may be provided between the introduction path 26*h* and the liquid ejecting apparatus 13 in the width direction Y or may be provided between the introduction path 26*h* and the mounting portion 42 in the width direction Y. By so doing, the liquid storage portion 41 can be moderately heated by the heat radiated from the second heating portion 55, and the viscosity of the liquid stored in the liquid storage portion 41 can be reduced.

(10) The black ink stored in the first liquid storage portion 41*a* is often used to print characters. The colored ink stored in the second liquid storage portions 41*b* is often used to print images. Accordingly, the amount of ink used per unit time when printing using colored ink is performed is larger than the amount of ink used per unit time when printing using black ink is performed. In that respect, the first heating portion 48 is, in the vertical direction Z, provided at a position above the second liquid storage portions 41*b* and at a position that is out of position with respect to the first liquid storage portion 41*a*. Accordingly, the second liquid storage portions 41*b* are heated more easily than the first liquid storage portion 41*a*. The liquid stored in the second liquid storage portions 41*b* will have viscosity that is lower than the viscosity of the liquid stored in the first liquid storage portion 41*a* and will be easier to supply; accordingly, insufficient supply of liquid can be reduced.

The present exemplary embodiment can be modified and implemented in the following manner. The present embodiment and the following modifications can be implemented in a combined manner within a technically consistent range.

Figure 3:
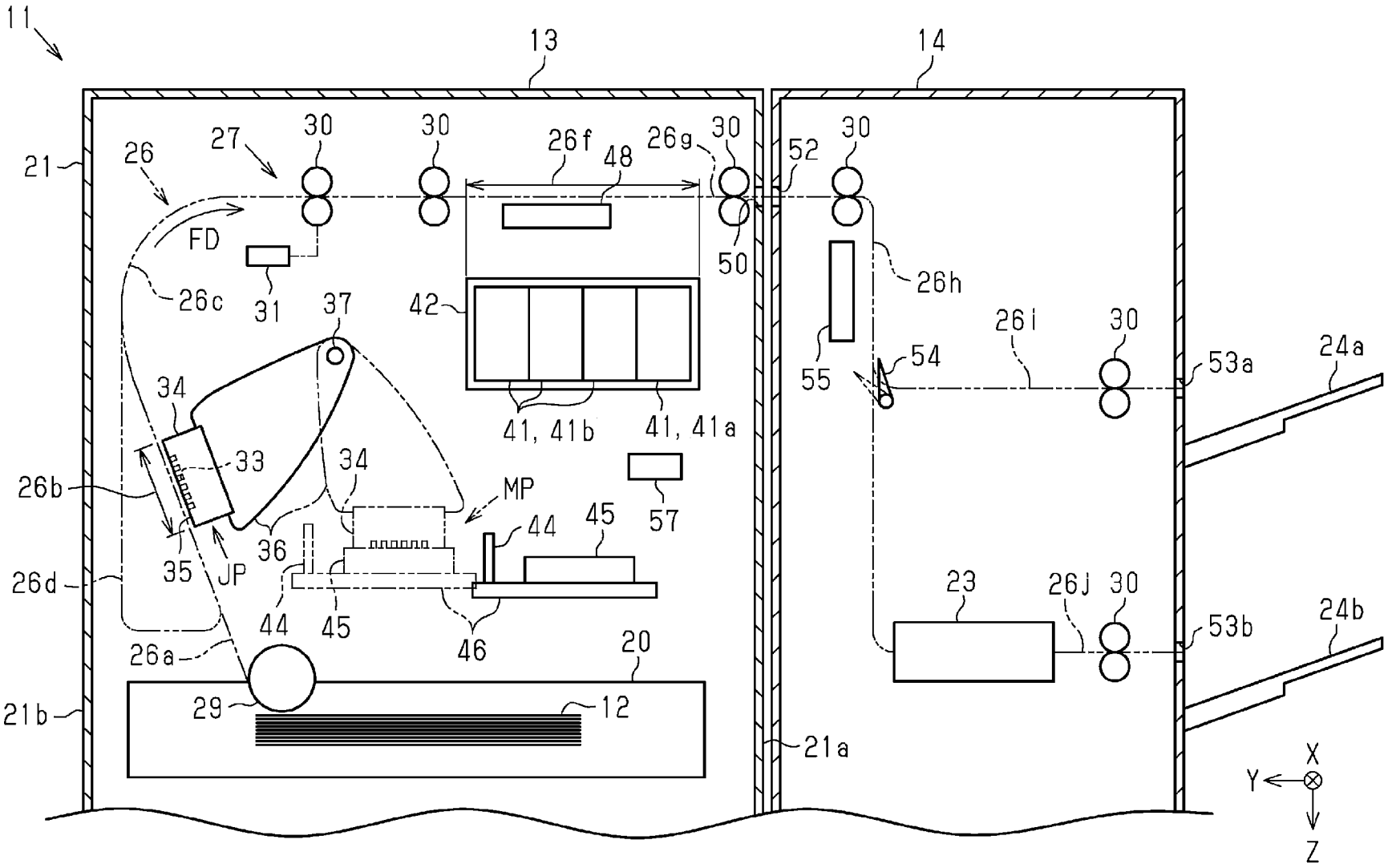
FIG. 3 is a schematic cross-sectional view of a first modification of the recording system.

As in a first modification illustrated in FIG. 3, the liquid ejecting apparatus 13 may include the recording unit 16 and a heating unit 17 in an integrated manner. In other words, the first heating portion 48 may be provided inside the housing 21. In the above, the downstream path 26*c* may be a path that couples the recording path 26*b* and the upper path 26*f* to each other.

Figure 4:
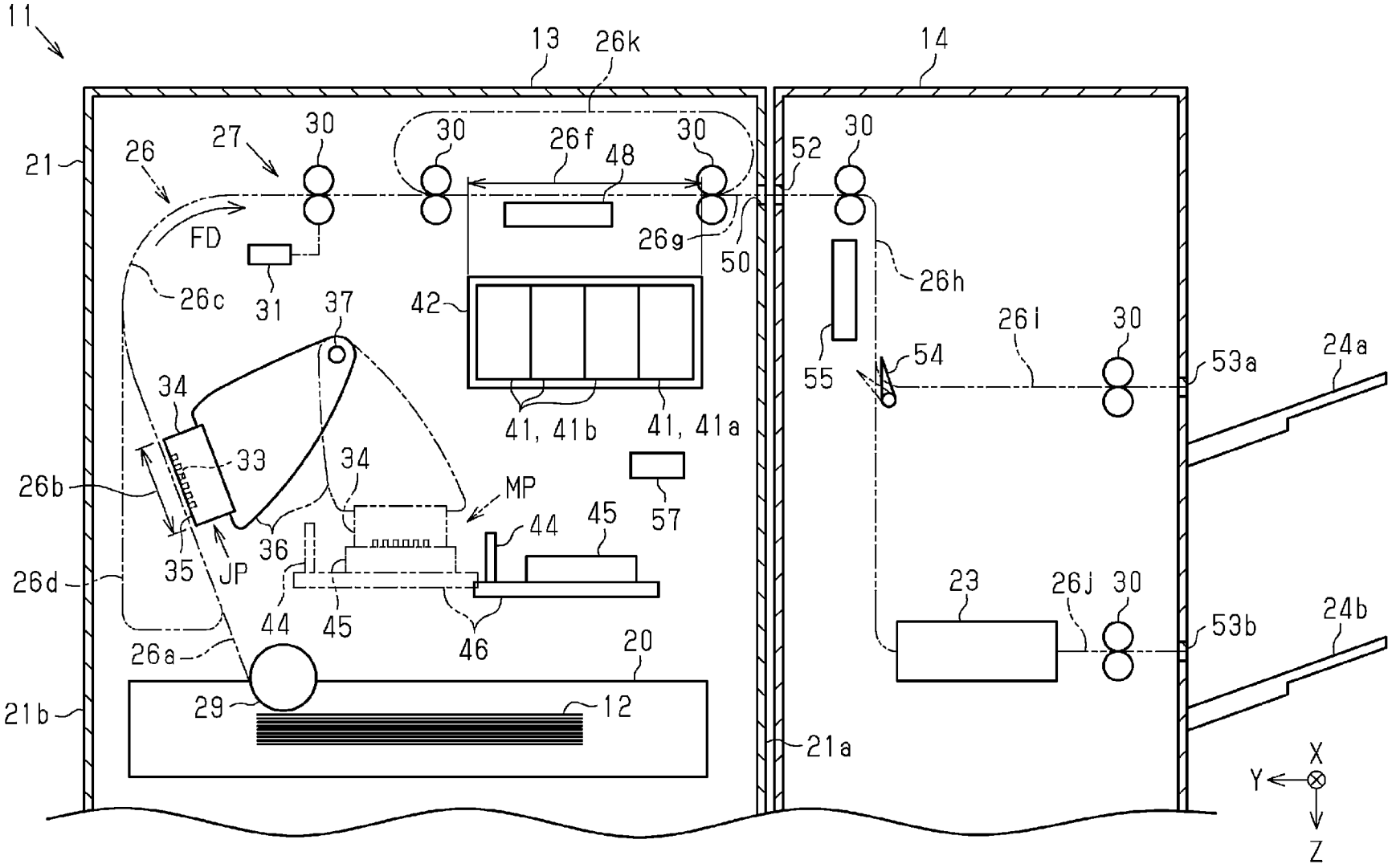
FIG. 4 is a schematic cross-sectional view of a second modification of the recording system.

As in a second modification illustrated in FIG. 4, the liquid ejecting apparatus 13 may include a circulation path 26*k*. The circulation path 26*k* couples the downstream path 26*c*, and the upper path 26*f* or the discharge path 26*g* to each other. When the heating unit 17 including the connection path 26*e*, the upper path 26*f*, the discharge path 26*g*, the circulation path 26*k*, the first heating portion 48, and the discharge port 50 is provided, the circulation path 26*k* couples the connection path 26*e*, and the upper path 26*f* or the discharge path 26*g* to each other. The circulation path 26*k* is a path that returns the medium 12 that has passed through the upper path 26*f* to a portion upstream of the upper path 26*f* in the transport direction FD. The transporting portion 27 may send the medium 12 that has passed through the upper path 26*f* to the circulation path 26*k* and have the medium 12 pass through the upper path 26*f* a plurality of times. The number of times that the medium 12 is passed through the upper path 26*f* may be set according to the print duty, for example. The print duty is a value of the average ejection amount, which indicates the amount of ejection per unit area when the liquid ejecting head 34 ejects a liquid onto the medium 12, when the maximum ejection amount is assumed as 100%. The value of the print duty can be acquired by having the control unit 57 analyze the recording data. The control unit 57 may circulate the medium 12 when the print duty is equivalent to or larger than a threshold value and may not circulate the medium 12 when the print duty is smaller than the threshold value. With the above, drying can be promoted when the print duty is high, and power consumption can be reduced when the print duty is low.

Figure 5:
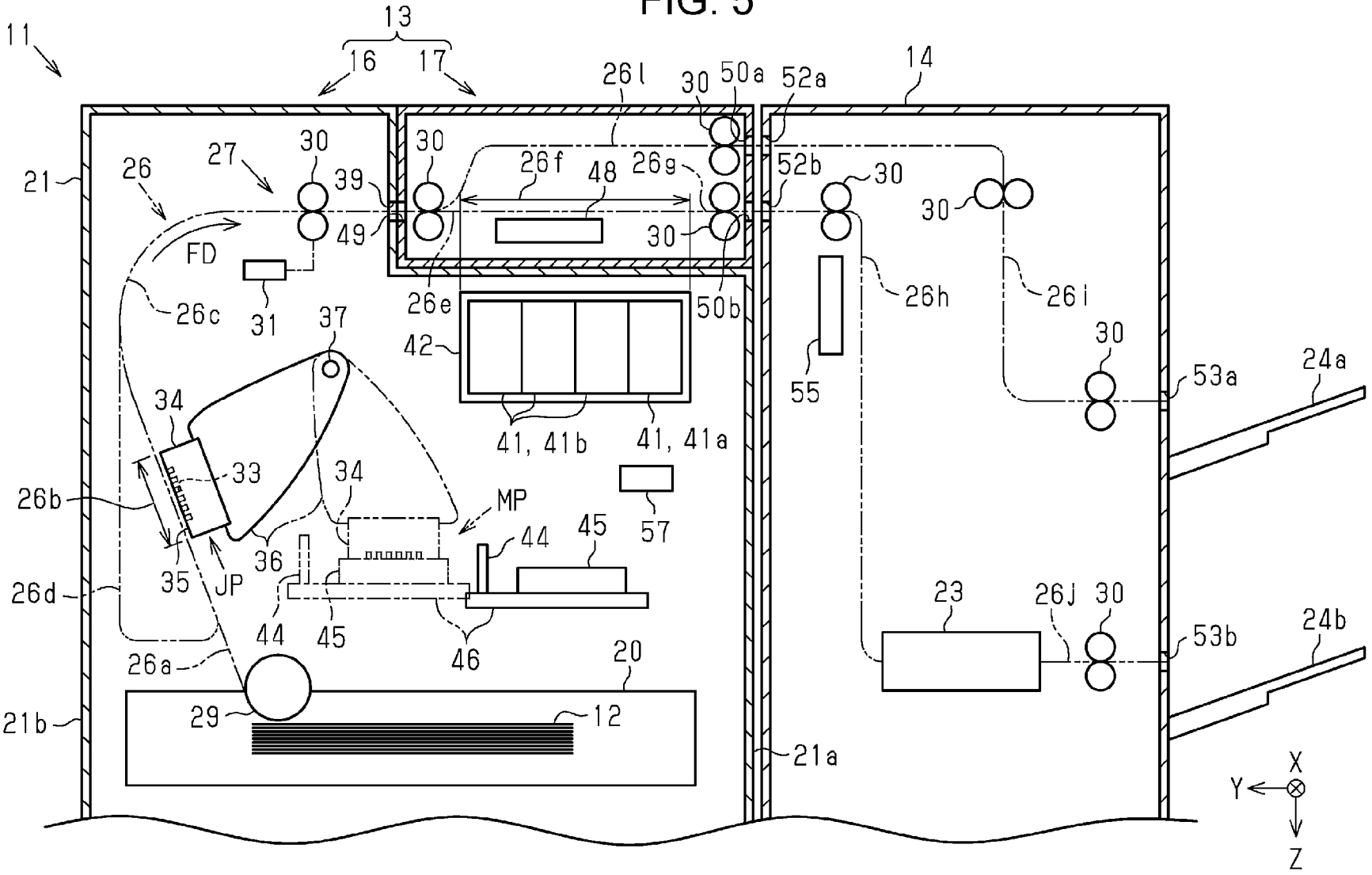
FIG. 5 is a schematic cross-sectional view of a third modification of the recording system.

As illustrated in a third modification illustrated in FIG. 5, the liquid ejecting apparatus 13 may include a branch path 261 that branches off from the connection path 26*e*. The branch path 261 couples the connection path 26*e* and a first discharge port 50*a* to each other. The discharge path 26*g* couples the upper path 26*f* and a second discharge port 50*b* to each other. The medium processing apparatus 14 may provide a first introduction port 52*a* through which the medium 12 discharged through the first discharge port 50*a* is introduced, and a second introduction port 52*b* through which the medium 12 discharged through the second discharge port 50*b* is introduced. The first delivery path 26*i* may couple the first introduction port 52*a* and the first delivery port 53*a* to each other. The introduction path 26*h* may couple the second introduction port 52*b* and the processing portion 23 to each other. Note that the branch path 261 may be branched off from the upper path 26*f* or may be branched off from the discharge path 26*g*. In either of the above, the transport path in the medium processing apparatus 14 can be simplified.

Figure 6:
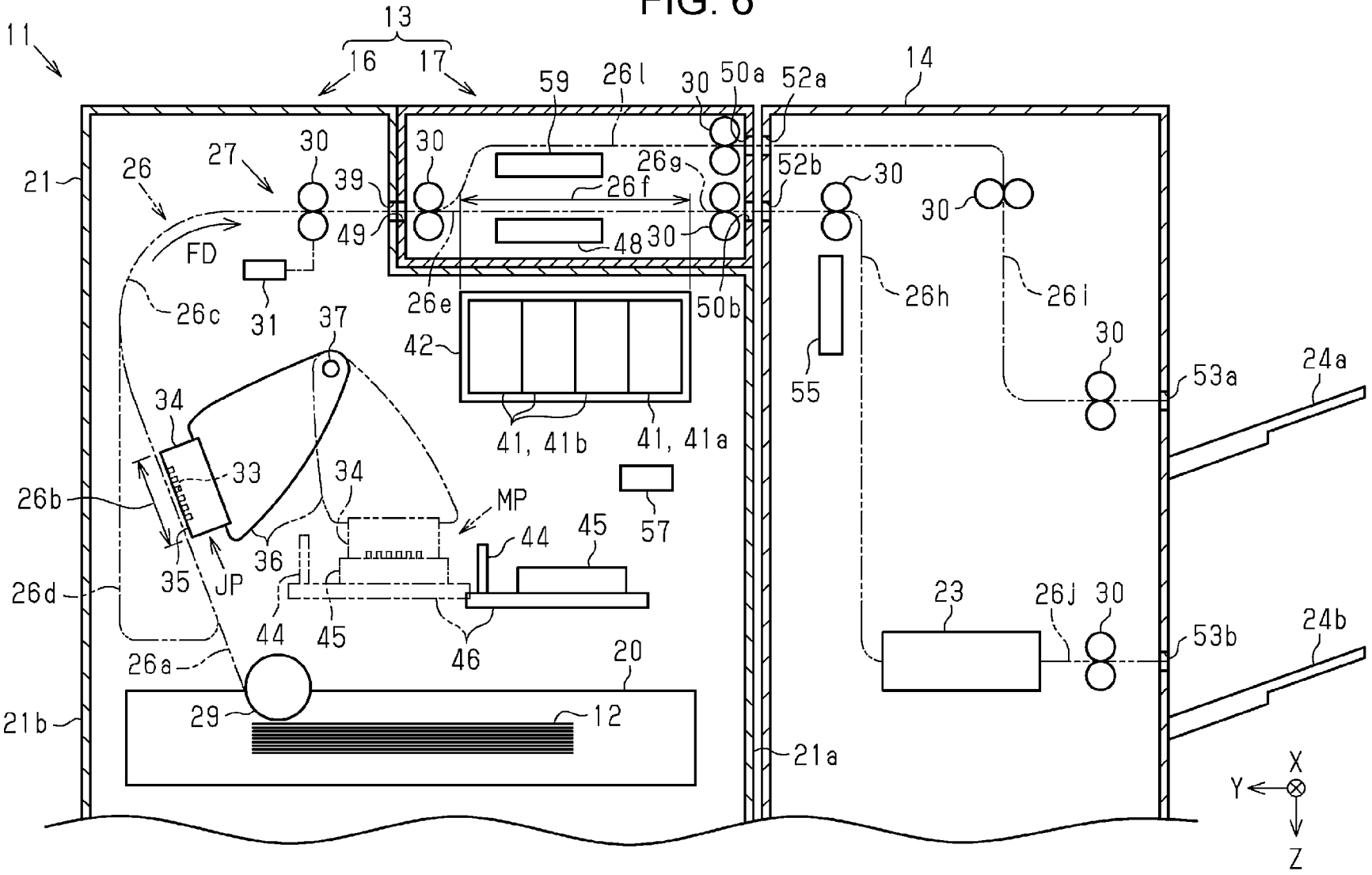
FIG. 6 is a schematic cross-sectional view of a fourth modification of the recording system.

As illustrated in a fourth modification illustrated in FIG. 6, the liquid ejecting apparatus 13 may include a third heating portion 59 that heats the medium 12 transported through the branch path 261. The third heating portion 59 may be provided between the branch path 261 and the upper path 26*f* in the vertical direction Z, and may heat the medium 12 transported above the mounting portion 42 in the vertical direction Z. With the above, the medium 12 on which no process is performed can be heated as well.

Figure 7:
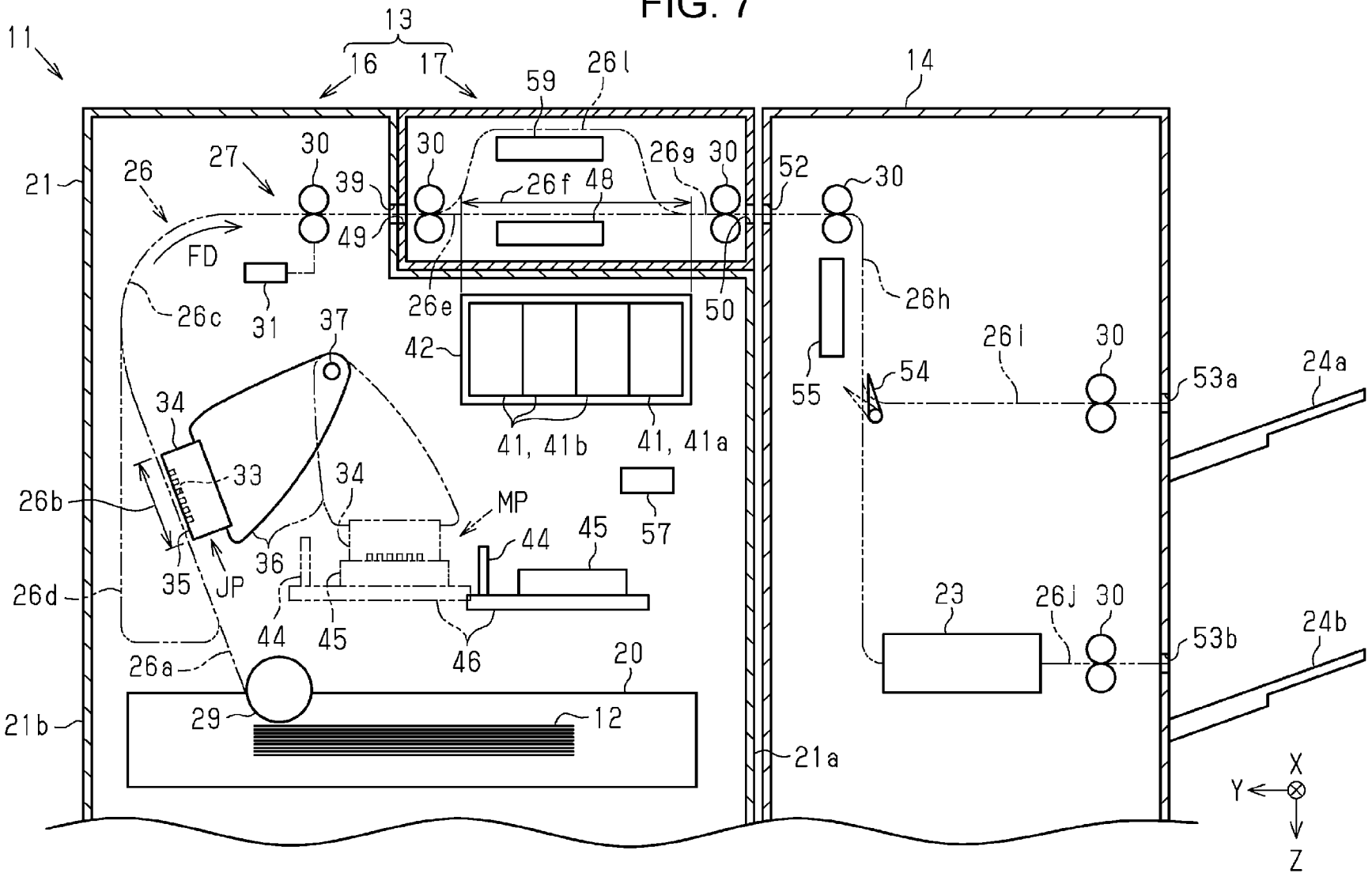
FIG. 7 is a schematic cross-sectional view of a fifth modification of the recording system.

As illustrated in a fifth modification illustrated in FIG. 7, the branch path 261 may be merged with the upper path 26*f*. The branch path 261 may be merged with the discharge path 26*g*. The medium 12 transported through the branch path 261 may be transported to the upper path 26*f* or the discharge path 26*g*, and may be sent to the medium processing apparatus 14 through the discharge port 50 and the introduction port 52. A length of the branch path 261 may be longer than a length of the medium 12 in the transport direction FD. The recording system 11 may have the medium 12 on which the process is to be performed stand by in the branch path 261. In other words, the branch path 261 may be used as a buffer. With the above, even when a process is performed in the processing portion 23 of the medium processing apparatus 14, the medium 12 can be transported in the recording unit 16.

Figure 8:
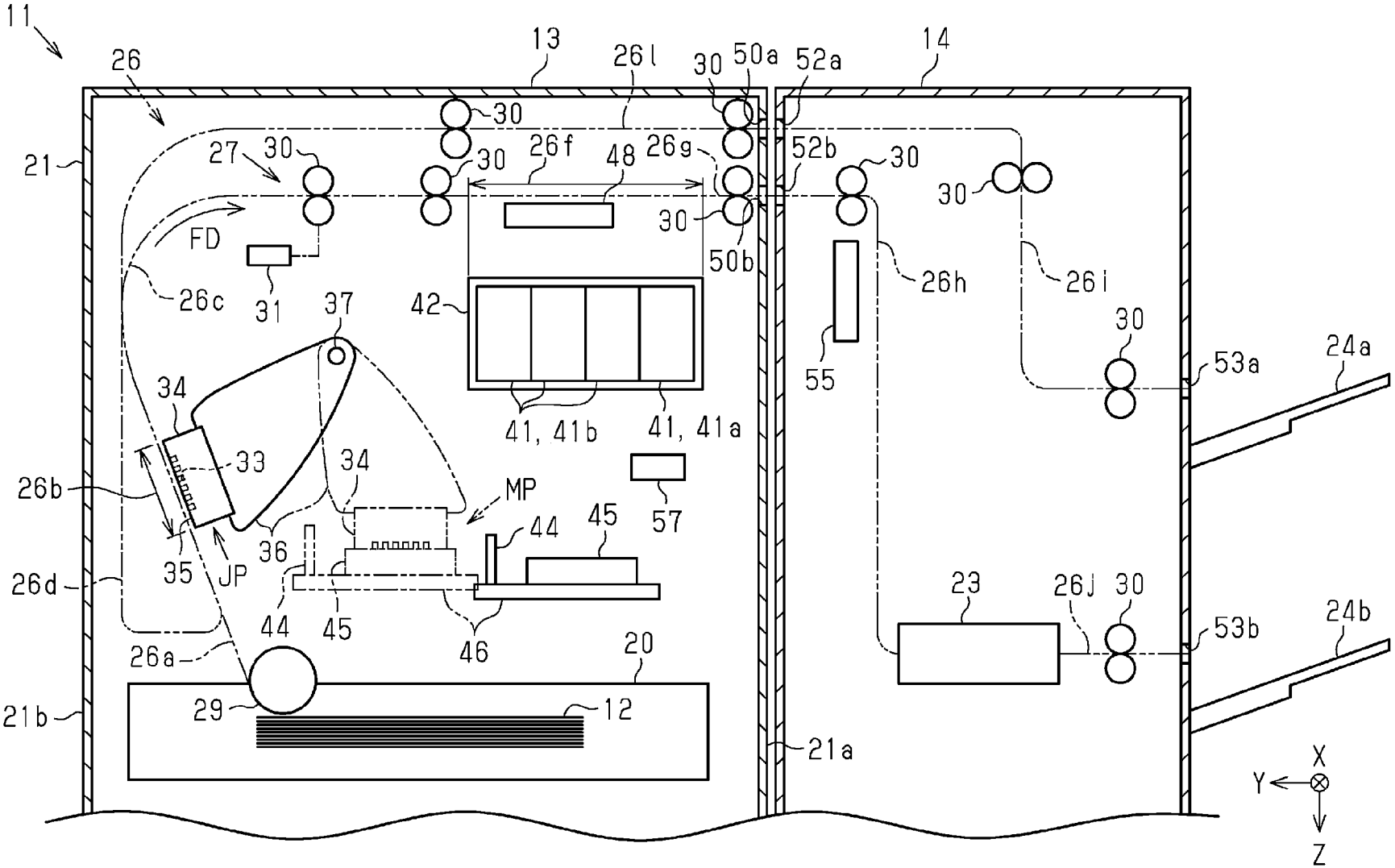
FIG. 8 is a schematic cross-sectional view of a sixth modification of the recording system.

As in a sixth modification illustrated in FIG. 8, the branch path 261 may be branched off from the downstream path 26*c*. The branch path 261 may be a path that couples the downstream path 26*c* and the first discharge port 50*a* to each other.

The recording system 11 may be provided with the first heating portion 48 alone or may be provided with the third heating portion 59 alone. The third heating portion 59 may heat both the medium 12 transported through the upper path 26*f* and the medium 12 transported through the branch path 261.

The first heating portion 48 to the third heating portion 59 may heat the medium 12 by applying warm air to the medium 12, may be a heat roller or a heat table that performs heating by contacting the medium 12, or may heat the medium 12 by radiation heat. The first heating portion 48 to the third heating portion 59 may each heat the medium 12 with a different method.

The medium processing apparatus 14 may include a single mounting portion on which the medium 12 is mounted. In other words, the medium processing apparatus 14 may mount the medium 12 on which the process has been performed by the processing portion 23, and the medium 12 on which no process has been performed on the same mounting portion. In the above, the medium 12 on which the process is to be performed may be mounted on the mounting portion after the process has been performed in the processing portion 23, and the medium 12 on which no process is performed may be passed through the processing portion 23 without any process performed thereon and may be mounted on the mounting portion. With the above, the transport path in the medium processing apparatus 14 can be simplified.

The first heating portion 48 may heat the medium 12 transported through the upper path 26*f* regardless of whether the process is to be performed by the processing portion 23.

The second heating portion 55 may heat the medium 12 transported through the introduction path 26*h* regardless of whether the process is to be performed by the processing portion 23.

The first heating portion 48 and the second heating portion 55 may be capable of changing the heating intensity. For example, the liquid ejecting apparatus 13 may intensify the heating on the medium 12 on which the process is to be performed by the processing portion 23 than the heating on the medium 12 on which the process is not to be performed by the processing portion 23, or may intensify the heating on the medium 12 on which recording of recording data in which the print duty is equivalent to or higher than the threshold value has been performed than the heating on the medium 12 on which recording of recording data in which the print duty is lower than the threshold value has been performed. Note that the threshold value is 30%, for example.

The cap 45 moving between the closed space forming position and the retracted position may move to a position that is out of position with respect to the mounting portion 42 in the vertical direction Z. The wiping portion 44 may move to a position that is out of position with respect to the mounting portion 42 in the vertical direction Z and wipe the liquid ejecting head 34.

The liquid ejecting head 34 may perform recording on the medium 12 at a position that is closer to the first side 21*a* than to the second side 21*b* in the width direction Y. The first heating portion 48 may be provided at a position that is closer to the second side 21*b* than to the first side 21*a* in the width direction Y.

The heating unit 17 may be provided inside the housing 21 of the recording unit 16.

The first heating portion 48 may be provided above the upper path 26*f* in the vertical direction Z.

The process performed by the processing portion 23 may be the following process. Punching in which holes are opened in the mediums 12. Shifting in which sets of mediums 12 are discharged while being shifted from each other. Shearing in which the mediums 12 are shorn. Cutting in which the mediums 12 are cut. Quiring in which the medium 12 is folded. Gathering and bookbinding in which the mediums 12 are bound into a book. Drying in which the mediums 12 are dried. Reading in which the information recorded on the medium 12 is read. Transporting in which the mediums 12 are transported.

The recording system 11 may perform a plurality of processes on the medium 12 on which recording has been performed. The recording system 11 may include a plurality of medium processing apparatuses 14. For example, the recording system 11 may include the liquid ejecting apparatus 13 that performs recording by ejecting a liquid onto the medium 12, an apparatus that performs transporting that transports the medium 12 on which recording has been performed, and the medium processing apparatus 14 that performs stapling on the mediums 12. For example, the recording system 11 may include the liquid ejecting apparatus 13 that performs recording by ejecting a liquid onto the medium 12, an apparatus that performs a reversing process that reverses the two sides of the medium 12 on which recording has been performed, and the medium processing apparatus 14 that performs stapling on the mediums 12.

The liquid ejecting apparatus 13 may be a liquid ejecting apparatus that injects or ejects a liquid other than ink. The state of the liquid ejected as minute amounts of droplets from the liquid ejecting apparatus includes a granular shape, a tear shape, or a shape with a threadlike trail. Furthermore, liquid used herein refers to any material that can be ejected by the liquid ejecting apparatus. For example, any material in a liquid state is sufficient and the liquid may include a fluid body, such as a liquid body with high or low viscosity, sol, gel water, and other inorganic solvents, an organic solvent, a solution, liquid resin, liquid metal, and metallic melt. Not just liquid as a state of matter, the liquid includes particles of functional material including a solid body such as pigment or metal particle that is dissolved, dispersed, or mixed in a solvent. A representative example of the liquid includes ink, liquid crystal, and others that have been described in the exemplary embodiment described above. Note that ink includes a variety of liquid compositions such as a general aqueous ink, solvent ink, and gel ink, and a hot melt ink. Examples of the liquid ejecting apparatus may include, for example, a liquid ejecting apparatus that ejects liquid that includes therein, in a dispersed or dissolved manner, a material such as an electrode material or a color material that is used to manufacture liquid crystal displays, electroluminescence displays, surface emitting displays, and color filters. The liquid ejecting apparatus may include, for example, an apparatus that ejects bio organic matter to manufacture biochips, an apparatus used as a precision pipette that ejects liquid serving as a sample, printing equipment, and a microdispenser. The liquid ejecting apparatus may be an apparatus that ejects lubricating oil in a pinpoint manner onto a precision instrument such as a clock or a camera, an apparatus that sprays transparent liquid resin such as ultraviolet curing resin on a substrate in order to form a hemispherical microlens and an optical lens used in optical communication elements. The liquid ejecting apparatus may be an apparatus that ejects acid, alkaline, or another etching solution for etching substrates and the like.

Technical ideas and the effects perceived from the exemplary embodiment and the modifications described above will be described below.

A. A liquid ejecting apparatus including a transporting portion that transports a medium along a transport path, a liquid ejecting head that performs recording by ejecting, through a nozzle, a liquid onto the medium that is being transported, a mounting portion in which a liquid storage portion that stores the liquid supplied to the liquid ejecting head is mounted, and a heating portion that heats the medium on which the recording has been performed. The transport path includes an upper path positioned above the mounting portion in a vertical direction. After transporting and passing the medium, on which the recording has been performed, through the upper path, the transporting portion discharges the medium through a discharge port. The heating portion is provided above the mounting portion in the vertical direction and heats the medium transported through the upper path.

According to the above configuration, when medium transported by the transporting portion is transported through the upper path positioned above the mounting portion, the medium is heated by the heating portion. Since the heating portion is provided above the mounting portion, the ascending air heated by the heating portion moves away from the liquid storage portion mounted in the mounting portion. Accordingly, while facilitating drying of the medium, the liquid storage portion can be suppressed from being excessively heated.

B. In the liquid ejecting apparatus, the heating portion may be provided between the mounting portion and the upper path in the vertical direction.

When a liquid in which the viscosity thereof is changed greatly by temperature is used, the viscosity of the liquid increases when the temperature is low. Accordingly, the liquid storage portion may not be able to supply a sufficient amount of liquid to the liquid ejecting head. In that respect, according to the above configuration, the heating portion is provided between the mounting portion and the upper path in the vertical direction. In other words, the air heated by the heating portion escapes upwards while the liquid storage portion is moderately heated by the heat radiated from the heating portion, which can reduce the viscosity of the liquid stored in the liquid storage portion.

C. In the liquid ejecting apparatus, the transport path may include a recording path in which the recording is performed by the liquid ejecting head, a downstream path positioned downstream from the recording path in a transport direction in which the medium is transported by the transporting portion, and a connection path that couples the downstream path and the upper path to each other. The heating portion, the connection path, the upper path, and the discharge port are integrally detachable from the liquid ejecting apparatus.

According to the above configuration, the heating unit provided with the heating portion is detachable from the recording unit. Accordingly, when the heating portion is replaced, for example, the heating portion can be replaced easily by removing the heating unit from the recording unit.

D. The liquid ejecting apparatus may further include a housing that houses the liquid ejecting head. The housing may include a first side, and a second side that is opposite the first side in a width direction. The liquid ejecting head may perform the recording on the medium at a position that is closer to the second side than to the first side in the width direction, and the heating portion may be provided at a position that is closer to the first side than to the second side in the width direction.

According to the above configuration, the liquid ejecting head performs printing on the medium at a position that is closer to the second side than to the first side in the width direction. The heating portion is provided at a position that is closer to the first side than to the second side. In other words, since the heating portion is provided away from the liquid ejecting head in the width direction, evaporation of the liquid inside the liquid ejecting head caused by the heating portion heating the liquid ejecting head can be suppressed.

E. The liquid ejecting apparatus may further include a wiping portion configured to wipe the liquid ejecting head. The wiping portion may wipe the liquid ejecting head by moving relative to the liquid ejecting head. A standby position where the wiping portion away from the liquid ejecting head stands by may be positioned below the mounting portion in the vertical direction. The wiping portion positioned at the standby position may overlap the mounting portion in the vertical direction.

When the wiping portion is heated, the liquid adhered to the wiping portion may evaporate and the viscosity of the liquid may increase. In that respect, according to the above configuration, the wiping portion positioned at the standby position is positioned below the mounting portion and overlaps the mounting portion in the vertical direction. In other words, when the wiping portion is positioned at the standby position, the mounting portion is positioned between the wiping portion and the heating portion; accordingly, heating of the wiping portion can be prevented with the mounting portion.

F. The liquid ejecting apparatus may further include a cap configured to form a closed space, in which the nozzle open, with the liquid ejecting head. The cap may be movable between a closed space forming position that forms the closed space, and a retracted position that is away from the closed space forming position. The retracted position may be positioned below the mounting portion in the vertical direction, and the cap positioned at the retracted position may overlap the mounting portion in the vertical direction.

When the cap is heated, the liquid adhered to the cap may evaporate and the viscosity of the liquid may increase. In that respect, according to the above configuration, the cap positioned at the retracted position is positioned below the mounting portion and overlaps the mounting portion in the vertical direction. In other words, when the cap is positioned at the retracted position, the mounting portion is positioned between the cap and the heating portion; accordingly, heating of the cap can be prevented with the mounting portion.

G. A recording system including a liquid ejecting apparatus that performs recording on a medium, a medium processing apparatus that includes a processing portion that performs a process on the medium on which recording has been performed with the liquid ejecting apparatus. The liquid ejecting apparatus includes a transporting portion that transports the medium along a transport path, a liquid ejecting head that performs the recording by ejecting, through a nozzle, a liquid onto the medium that is being transported, a mounting portion in which a liquid storage portion that stores the liquid supplied to the liquid ejecting head is mounted, and a heating portion that heats the medium on which the recording has been performed. The transport path includes an upper path positioned above the mounting portion in a vertical direction, the transporting portion transports and passes the medium, on which the recording has been performed, through the upper path and discharges the medium through a discharge port and towards the medium processing apparatus, and the heating portion is provided above the mounting portion in the vertical direction and heats the medium transported through the upper path. According to the above configuration, an effect similar to that of the liquid ejecting apparatus described above can be obtained.

H. In the recording system, the transport path may include a recording path in which the recording is performed by the liquid ejecting head, a downstream path positioned downstream of the recording path in a transport direction in which the medium is transported by the transporting portion, and a connection path that couples the downstream path and the upper path to each other. The heating portion, the connection path, the upper path, and the discharge port are integrally detachable from the liquid ejecting apparatus. According to the above configuration, an effect similar to that of the liquid ejecting apparatus described above can be obtained.

I. In the recording system, the heating portion may be provided between the mounting portion and the upper path in the vertical direction. According to the above configuration, an effect similar to that of the liquid ejecting apparatus described above can be obtained.

J. In the recording system, the liquid ejecting apparatus may further include a housing that houses the liquid ejecting head. The housing may include a first side, and a second side that is opposite the first side in a width direction. The liquid ejecting head may perform the recording on the medium at a position that is closer to the second side than to the first side in the width direction, and the heating portion may be provided at a position that is closer to the first side than to the second side in the width direction. According to the above configuration, an effect similar to that of the liquid ejecting apparatus described above can be obtained.

K. In the recording system, the liquid ejecting apparatus may further include a wiping portion configured to wipe the liquid ejecting head. The wiping portion may wipe the liquid ejecting head by moving relative to the liquid ejecting head. A standby position where the wiping portion away from the liquid ejecting head stands by may be positioned below the mounting portion in the vertical direction. The wiping portion positioned at the standby position may overlap the mounting portion in the vertical direction. According to the above configuration, an effect similar to that of the liquid ejecting apparatus described above can be obtained.

L. In the recording system, the liquid ejecting apparatus may further include a cap configured to form a closed space in which the nozzle open. The cap may be movable between a closed space forming position that forms the closed space, and a retracted position that is away from the closed space forming position. The retracted position may be positioned below the mounting portion in the vertical direction, and the cap positioned at the retracted position may overlap the mounting portion in the vertical direction. According to the above configuration, an effect similar to that of the liquid ejecting apparatus described above can be obtained.

M. In the recording system, the heating portion may heat the medium when the processing portion is to perform the process on the medium, and the processing portion may perform the process on the medium that has been heated.

For example, when the mediums are mounted while not being sufficiently dried, the mediums may be displaced with respect to each other and the process may not be performed appropriately. In that respect, according to the above configuration, the processing portion performs a process on the mediums that have been heated by the heating portion. Accordingly, insufficient drying of the mediums on which the process is performed can be suppressed.

N. In the recording system, the medium processing apparatus may include a first mounting portion that mounts thereon a medium on which the process has not been performed by the processing portion, and a second mounting portion that mounts thereon a medium on which the process has been performed by the processing portion.

According to the above configuration, the medium processing apparatus includes the first mounting portion on which the medium on which no process is performed by the processing portion is mounted, and the second mounting portion on which the medium on which the process is performed by the processing portion is mounted.

Accordingly, the medium on which no process has been performed and the medium on which the process has been performed can be sorted easily.

O. In the recording system, when the heating portion is a first heating portion, the medium processing apparatus may include a second heating portion that heats the medium transported through an introduction path between an introduction port, which introduces the medium discharged from the liquid ejecting apparatus, and the processing portion.

According to the above configuration, the medium processing apparatus includes the second heating portion that heats the medium transported through the introduction path. Accordingly, compared with heating the medium with the first heating portion alone, insufficient drying of the medium on which the process is performed by the processing portion can be suppressed.

What is claimed is:

1. A liquid ejecting apparatus comprising:

a transporting portion that transports a medium along a transport path;

a liquid ejecting head that performs recording by ejecting, through a nozzle, a liquid onto the medium that is being transported;

a mounting portion in which a liquid storage portion that stores the liquid supplied to the liquid ejecting head is mounted, the mounting portion being provided at a position higher in a vertical direction than the nozzle; and a heating portion that heats the medium on which the recording has been performed, wherein the transport path includes an upper path positioned above the mounting portion in the vertical direction, after transporting and passing the medium, on which the recording has been performed, through the upper path, the transporting portion discharges the medium through a discharge port, and the heating portion is provided above the mounting portion in the vertical direction and heats the medium transported through the upper path.

2. The liquid ejecting apparatus according to claim 1, wherein the heating portion is provided between the mounting portion and the upper path in the vertical direction.

3. The liquid ejecting apparatus according to claim 1, wherein the transport path includes, a recording path in which the recording is performed by the liquid ejecting head, a downstream path positioned downstream from the recording path in a transport direction in which the medium is transported by the transporting portion, and a connection path that couples the downstream path and the upper path to each other, the heating portion, the connection path, the upper path, and the discharge port are integrally detachable from the liquid ejecting apparatus.

4. The liquid ejecting apparatus according to claim 1, further comprising:

a housing that houses the liquid ejecting head, wherein the housing includes, a first side, and a second side that is opposite the first side in a width direction, the liquid ejecting head performs the recording on the medium at a position that is closer to the second side than to the first side in the width direction, and the heating portion is provided at a position that is closer to the first side than to the second side in the width direction.

5. The liquid ejecting apparatus according to claim 1, further comprising:

a wiping portion configured to wipe the liquid ejecting head, wherein the wiping portion wipes the liquid ejecting head by moving relative to the liquid ejecting head, a standby position where the wiping portion away from the liquid ejecting head stands by is positioned below the mounting portion in the vertical direction, and the wiping portion positioned at the standby position overlaps the mounting portion in the vertical direction.

6. The liquid ejecting apparatus according to claim 1, further comprising:

a cap configured to form a closed space, in which the nozzle opens, with the liquid ejecting head, wherein the cap is movable between a closed space forming position that forms the closed space, and a retracted position that is away from the closed space forming position, the retracted position is positioned below the mounting portion in the vertical direction, and the cap positioned at the retracted position overlaps the mounting portion in the vertical direction.

7. A recording system, comprising:

a liquid ejecting apparatus that performs recording on a medium; and a medium processing apparatus that includes a processing portion that performs a process on the medium on which recording has been performed with the liquid ejecting apparatus, wherein the liquid ejecting apparatus includes, a transporting portion that transports the medium along a transport path, a liquid ejecting head that performs the recording by ejecting, through a nozzle, a liquid onto the medium that is being transported;

a mounting portion in which a liquid storage portion that stores the liquid supplied to the liquid ejecting head is mounted, the mounting portion being provided at a position higher in a vertical direction than the nozzle, and a heating portion that heats the medium on which the recording has been performed, wherein the transport path includes an upper path positioned above the mounting portion in the vertical direction, the transporting portion transports and passes the medium, on which the recording has been performed, through the upper path and discharges the medium through a discharge port and towards the medium processing apparatus, and the heating portion is provided above the mounting portion in the vertical direction and heats the medium transported through the upper path.

8. The recording system according to claim 7, wherein the transport path includes, a recording path in which the recording is performed by the liquid ejecting head, a downstream path positioned downstream from the recording path in a transport direction in which the medium is transported by the transporting portion, and a connection path that couples the downstream path and the upper path to each other, the heating portion, the connection path, the upper path, and the discharge port are integrally detachable from the liquid ejecting apparatus.

9. The recording system according to claim 7, wherein the heating portion is provided between the mounting portion and the upper path in the vertical direction.

10. The recording system according to claim 7, wherein the liquid ejecting apparatus further includes a housing that houses the liquid ejecting head the housing includes, a first side, and a second side that is opposite the first side in a width direction, the liquid ejecting head performs the recording on the medium at a position that is closer to the second side than to the first side in the width direction, and the heating portion is provided at a position that is closer to the first side than to the second side in the width direction.

11. The recording system according to claim 7, wherein the liquid ejecting apparatus further includes a wiping portion configured to wipe the liquid ejecting head, the wiping portion wipes the liquid ejecting head by moving relative to the liquid ejecting head, a standby position where the wiping portion away from the liquid ejecting head stands by is positioned below the mounting portion in the vertical direction, and the wiping portion positioned at the standby position overlaps the mounting portion in the vertical direction.

12. The recording system according to claim 7, wherein the liquid ejecting apparatus further includes a cap configured to form a closed space in which the nozzle opens, the cap is movable between a closed space forming position that forms the closed space, and a retracted position that is away from the closed space forming position, the retracted position is positioned below the mounting portion in the vertical direction, and the cap positioned at the retracted position overlaps the mounting portion in the vertical direction.

13. The recording system according to claim 7, wherein the heating portion heats the medium when the processing portion is to perform the process on the medium, and the processing portion performs the process on the medium that has been heated.

14. The recording system according to claim 7, wherein the medium processing apparatus includes, a first mounting portion that mounts thereon a medium on which the process has not been performed by the processing portion, and a second mounting portion that mounts thereon a medium on which the process has been performed by the processing portion.

15. The recording system according to claim 7, wherein when the heating portion is a first heating portion, the medium processing apparatus includes a second heating portion that heats the medium transported through an introduction path between an introduction port, which introduces the medium discharged from the liquid ejecting apparatus, and the processing portion.

16. A liquid ejecting apparatus comprising:

a transporting portion that transports a medium along a transport path;

a liquid ejecting head that performs recording by ejecting, through a nozzle, a liquid onto the medium that is being transported;

a mounting portion in which a liquid storage portion that stores the liquid supplied to the liquid ejecting head is mounted; and a heating portion that heats the medium on which the recording has been performed, wherein the transport path includes an upper path positioned above the mounting portion in a vertical direction, after transporting and passing the medium, on which the recording has been performed, through the upper path, the transporting portion discharges the medium through a discharge port, and the heating portion is provided above the mounting portion in the vertical direction and heats the medium transported through the upper path, the transport path includes:

a recording path in which the recording is performed by the liquid ejecting head, a downstream path positioned downstream from the recording path in a transport direction in which the medium is transported by the transporting portion, and a connection path that couples the downstream path and the upper path to each other, the heating portion, the connection path, the upper path, and the discharge port are integrally detachable from the liquid ejecting apparatus.

* * * * *